US011162729B2

(12) United States Patent
Yoo et al.

(10) Patent No.: US 11,162,729 B2
(45) Date of Patent: Nov. 2, 2021

(54) DRIP TRAY FOR A COMPACT MACHINE COMPARTMENT AND REFRIGERATOR USING A DRIP TRAY

(71) Applicant: LG ELECTRONICS INC., Seoul (KR)

(72) Inventors: Myungkeun Yoo, Seoul (KR); Yongdae Kim, Seoul (KR); Hohyun Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 135 days.

(21) Appl. No.: 16/148,266

(22) Filed: Oct. 1, 2018

(65) Prior Publication Data

US 2019/0120541 A1 Apr. 25, 2019

(30) Foreign Application Priority Data

Oct. 23, 2017 (KR) ..... 10-2017-0137789

(51) Int. Cl.
*F25D 21/14* (2006.01)
*F25D 23/00* (2006.01)

(52) U.S. Cl.
CPC ..... *F25D 21/14* (2013.01); *F25D 23/006* (2013.01); *F25D 2321/144* (2013.01)

(58) Field of Classification Search
CPC ..... F25D 21/14; F25D 23/006; F25D 2321/1411; F25D 2321/1412; F25D 19/00; F25D 2321/144; F25D 23/003; F25D 2323/0028; F25D 2321/1441
USPC ..... 62/291
See application file for complete search history.

(56) References Cited

U.S. PATENT DOCUMENTS 4,490,990 A * 1/1985 Chastine ..... F25D 21/14 62/279
4,823,558 A * 4/1989 Kim ..... F25D 21/14 62/272
5,953,929 A * 9/1999 Bauman ..... F25D 19/00 62/259.1
2004/0069464 A1* 4/2004 Erisgen ..... F25D 23/006 165/121

(Continued)

FOREIGN PATENT DOCUMENTS

CN 1648567 A 8/2005
CN 201262505 6/2009

(Continued)

OTHER PUBLICATIONS

Korean Office Action dated Oct. 18, 2018 issued in KR Application No. 10-2017-0137789.

(Continued)

*Primary Examiner* — Steve S Tanenbaum
(74) *Attorney, Agent, or Firm* — KED & Associates LLP

(57) ABSTRACT

A drip tray provided in a machine compartment of a refrigerator including a fan assembly accommodation space blocked from a defrosted water storage space via an inner wall such that defrosted water does not flow into the fan assembly accommodation space. The fan assembly includes a cutout, wherein the cut-out overlaps a portion of the defrosted water storage space beyond the inner wall when the fan assembly is provided in the fan assembly accommodation space.

19 Claims, 11 Drawing Sheets

(56) References Cited

U.S. PATENT DOCUMENTS

| | | | | |
|---|---|---|---|---|
| 2006/0117789 | A1* | 6/2006 | Yamasaki | F25D 19/00 62/448 |
| 2006/0162373 | A1* | 7/2006 | McMillin | A47B 96/062 62/440 |
| 2010/0139309 | A1* | 6/2010 | Kim | F25D 23/006 62/419 |
| 2013/0276471 | A1 | 10/2013 | Austin et al. | |
| 2017/0254582 | A1* | 9/2017 | Lesko | F25B 13/00 |

FOREIGN PATENT DOCUMENTS

| | | | |
|---|---|---|---|
| CN | 201262505 | Y * | 6/2009 |
| CN | 103148657 | A | 6/2013 |
| CN | 107144072 | A | 9/2017 |
| EP | 2 759 790 | A2 | 7/2014 |
| JP | S55-048016 | | 3/1980 |
| JP | 2001-133129 | | 5/2001 |
| JP | 4555142 | | 9/2010 |
| JP | 2014-115013 | A | 6/2014 |
| KR | 2001-0092062 | A | 10/2001 |
| KR | 10-2005-0102814 | | 10/2005 |
| KR | 10-2009-0072734 | | 7/2009 |
| KR | 10-2009-0080240 | | 7/2009 |
| KR | 10-2010-0063879 | | 6/2010 |
| KR | 10-1564099 | | 10/2015 |
| WO | WO 2007/012157 | | 2/2007 |

OTHER PUBLICATIONS

Korean Notice of Allowance dated Jan. 31, 2019 issued in KR Application No. 10-2017-0171586.

European Search Report dated Mar. 1, 2019 issued in EP Application No. 18201975.2.

European Search Report dated Mar. 14, 2019 issued in EP Application No. 18201980.2.

Chinese Office Action dated Jun. 3, 2020 issued in Application 201811281509.2.

Extended European Search Report dated Jul. 20, 2020 issued in Application 20171546.3.

* cited by examiner

DRIP TRAY FOR A COMPACT MACHINE COMPARTMENT AND REFRIGERATOR USING A DRIP TRAY

CROSS-REFERENCE TO RELATED APPLICATION(S)

This application claims the priority of Korean Patent Application No. 10-2017-0137789 filed on Oct. 23, 2017, in the Korean Intellectual Property Office, the disclosure of which is hereby incorporated by reference in its entirety.

BACKGROUND

1. Field

The present disclosure relates to a refrigerator having a compact machine compartment.

2. Background

A machine compartment may be provided in a rear lower portion of a refrigerator. The machine compartment may accommodate a compressor and a condenser that generate heat in a refrigerating cycle of the refrigerator. A drip tray configured to receive defrosted water as generated in an evaporator used to cool a cabinet of the refrigerator may be provided in the machine compartment.

The defrosted water stored in the drip tray may be evaporated by the heat released from the compressor and condenser of the machine compartment. The drip tray may have a flat and wide shape to widen a surface area in contact with the atmosphere. The machine compartment may include a fan which generates an air flow through the compressor and the condenser. The air flow may be used to evaporate the water contained in the drip tray.

BRIEF DESCRIPTION OF THE DRAWINGS

Embodiments will be described in detail with reference to the following drawings in which like reference numerals refer to like elements, and wherein.

DETAILED DESCRIPTION

Figure 1:
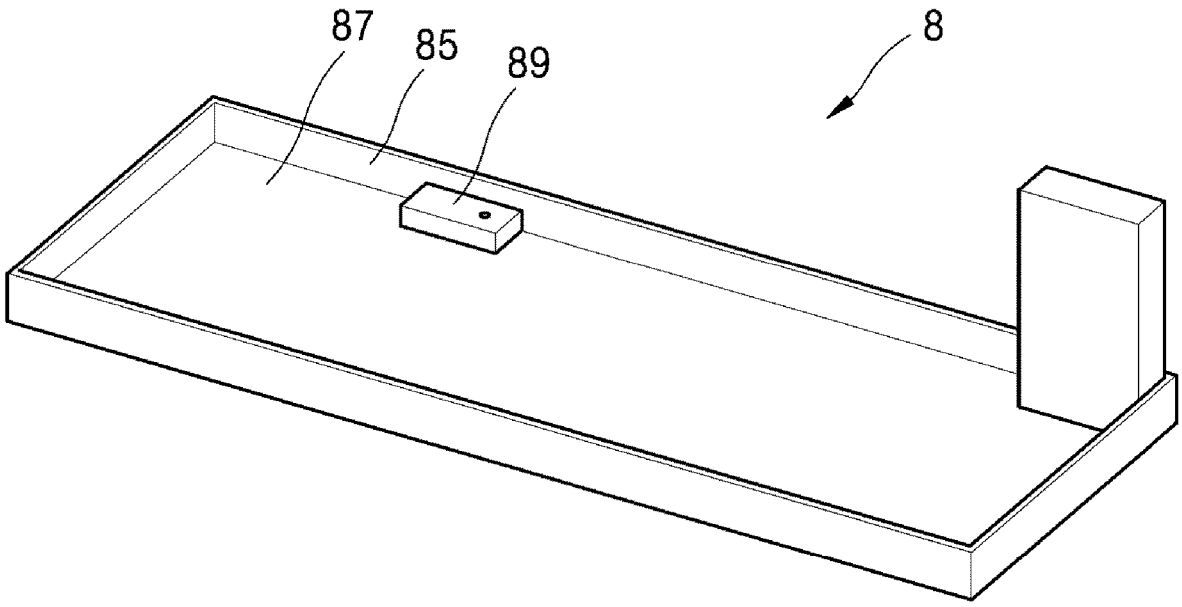
FIG. 1 is a perspective view of a drip tray used in a related refrigerator machine compartment.

As shown in FIG. 1, a drip tray 8 may have a form of a tray having a rectangular broad bottom member 87 and an outer wall 85 having a small vertical dimension and extending upwardly from an edge of the bottom member. The defrosted water may be received in a space defined by the bottom member and the outer wall.

Figure 2:
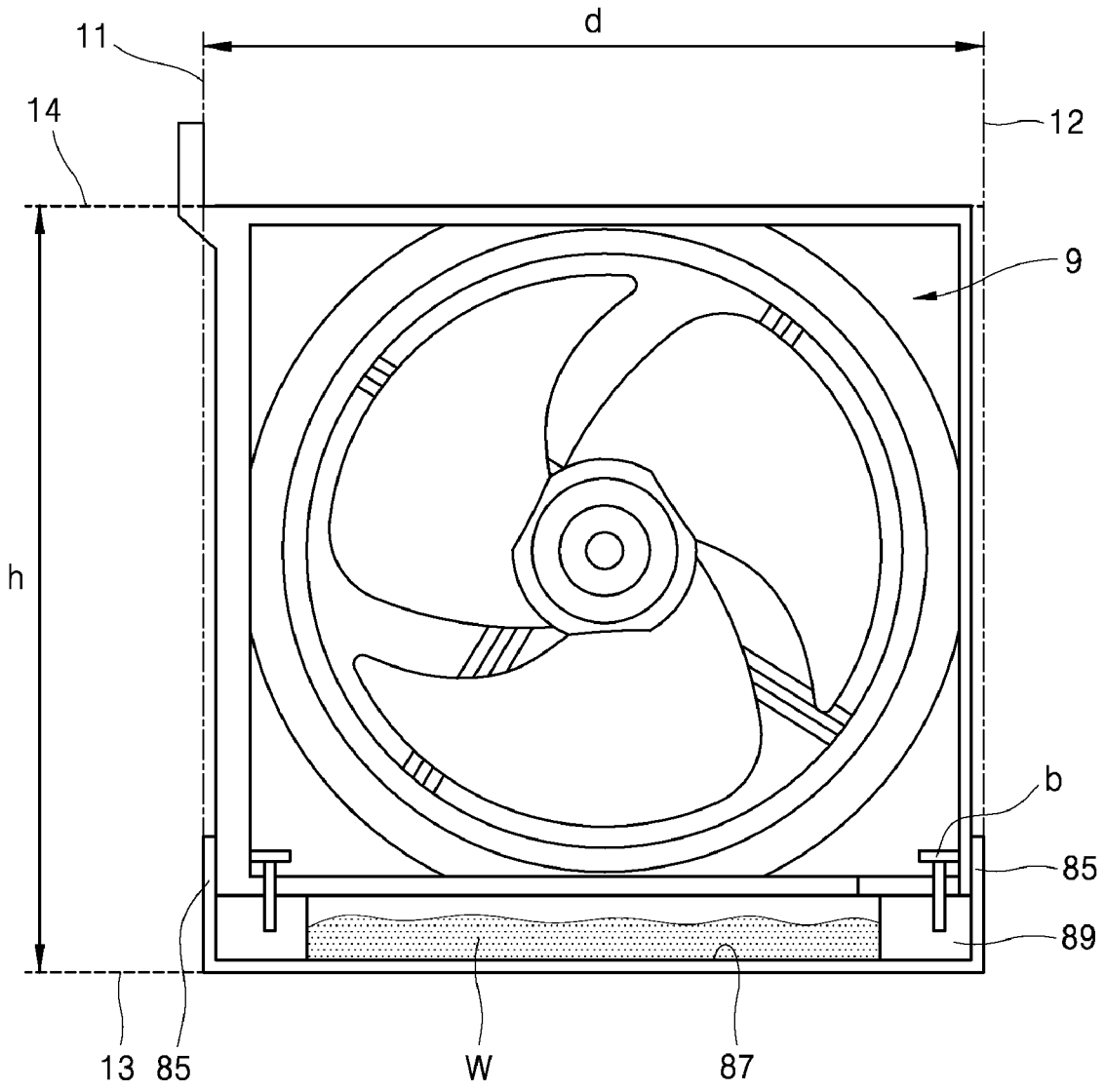
FIG. 2 is a cross-sectional side view of a coupled state between a drip tray and a fan assembly housed in the related machine compartment.

Referring to FIG. 1 and FIG. 2, defrosted water w may be stored in the drip tray 8. Thus, a fan assembly 9 may be provided above the bottom member 87 of the drip tray 8. In this connection, the fan assembly 9 may be placed on a fan assembly support 89 provided inside the drip tray 8 and may be fixed to the support by a fastener such as a screw b. Further, a lower end of the fan assembly 9 may be interposed between two outer walls 85 of the tray drip 8.

A height h of the machine compartment housing the drip tray 8 and the fan assembly 9 may be determined by a distance between a bottom boundary 13 extending horizontally from the bottom member 87 of the tray drip 8 and a top boundary 14 extending horizontally from a top of the fan assembly 9. That is, the height h of the machine compartment according to FIGS. 1 and 2 may be equal to a sum of a height of the fan assembly support 89 and a height of the fan assembly 9.

Furthermore, a depth d of the machine compartment according to FIGS. 1 and 2 may be determined by a distance between the two parallel and spaced outer walls 85 of the drip tray 8 defining a space receiving the lower end of the fan assembly 9. According to the combined structure of the drip tray 8 and the fan assembly 9 in FIGS. 1 and 2, reducing the height h and depth d of the machine compartment should result from the reduction of the size of the fan assembly 9. However, when the size of the fan assembly 9 is reduced, there may be a problem that a fan flow rate is reduced correspondingly.

Figure 3:
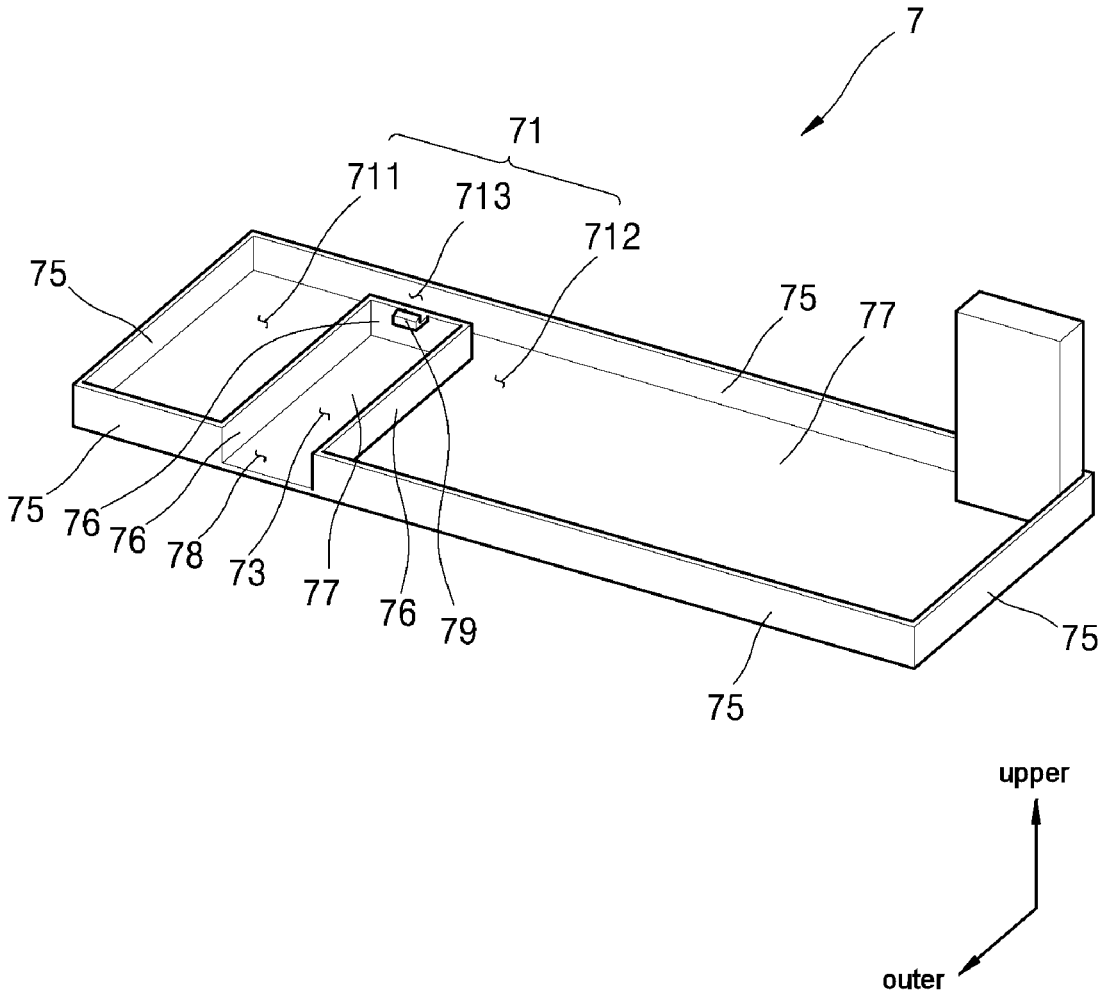
FIG. 3 is a perspective view of an embodiment of a drip tray used in a refrigerator machine compartment.

An embodiment of a drip tray provided in a machine compartment may include, as shown in FIG. 3, a bottom member or panel 77 formed of a plate having a substantially rectangular shape, and an outer or first wall 75 that extends upward from an edge of the bottom panel 77. The bottom panel 77 may be made of metal or plastic. The bottom panel 77 may have a rectangular shape including short sides and long sides. Along a predetermined length at the long side edge of the bottom panel 77, an opening 78 at which the outer wall is not formed may be defined. That is, the outer wall may extend upward from the edge of the bottom panel 77 along a periphery of the bottom panel 77 except for the opening 78 region.

Further, the drip tray 7 may include an inner or second wall 76 that extends from both ends of the opening 78 of the bottom panel 77. The inner wall 76 may extend in a perpendicular manner to the long side of the bottom panel 77 and may extend along the bottom panel 77. That is, the inner wall 76 may extend inward from the long side of the bottom panel 77. The direction in which the inner wall 76 extends inward from the long side of the bottom panel 77 may be parallel to the extending direction of the short side of the bottom panel 77.

The inner wall 76 may extend upward from the bottom panel 77. The inner wall 76 may be connected to the outer wall 75 at the opening 78. The inner wall 76 may have a "⊃" shape. That is, an opposite portion to the opening 78 may be closed. The inner wall 76 may include a first inner wall and a second inner wall, and both may extend in a direction parallel to the short side of the bottom panel 77, and a third inner wall that connects distal ends of the first and second inner walls to each other. That is, the proximal ends of the first inner wall and the second inner wall may be connected to the outer wall 75 of the bottom panel 77, while the distal ends of the first inner wall and the second inner wall may be interconnected via the third inner wall.

The first inner wall and the second inner wall may extend parallel to each other and may be parallel to the short side of the bottom panel 77. The third inner wall may be shorter than each of the first and second inner walls. The third inner wall may be parallel to the long side of the bottom panel 77.

According to an embodiment, the drip tray 7 may include outer walls that define two short sides and one long side of the rectangular shaped bottom panel 77, and an outer wall that defines the other long side except for the opening 78. That is, the outer wall 75 may define all the edges of the bottom panel 77 except for the opening 78.

Further, the inner wall 76 may be connected to the outer wall 75 and may extend inward from an edge of the bottom panel 77. Accordingly, the outer wall 75 and the inner wall 76 of the drip tray 7 may form a closed loop.

A space defined by the bottom panel 77 and the closed loop formed by the outer wall 75 and the inner wall 76 may define a defrosted water storage space (or water storage space) 71. The defrosted water storage space 71 may be divided into two spaces as divided by the inner wall 76. A first storage space 711 may be defined to one side of the inner wall 76 along the longitudinal direction of the long side of the bottom panel 77, while a second storage space 712 may be defined to the other side of the inner wall along the longitudinal direction of the long side of the bottom panel 77.

The second storage space 712 may occupy a wider area than the first storage space 711. In the second storage space, a heat-exchanger condenser to be described later may be provided.

The first storage space 711 and the second storage space 712 may communicate with each other through a communication space 713. The communication space 713 may be defined between the third inner wall and the outer wall. Since the defrosted water is a liquid, the defrosted water contained in the first storage space 711 and the defrosted water contained in the second storage space 712 may communicate with each other through the communication space 713 and may have the same water level.

On the bottom panel 77, a space excluding the defrosted water storage space 71 defined by the first storage space, the second storage space, and the communication space may define a fan assembly accommodation space (or fan assembly mounting space) 73 into which the defrosted water w does not invade. The fan assembly accommodation space 73 may have a form of an elongated rectangular shape. The space 73 may be defined by the inner wall 76 defining two long sides and one short side. The other short side of the space 73 may be defined by the opening 78.

The fan assembly accommodation space 73 may not accommodate defrosted water therein. Thus, in the location of the fan assembly accommodation space 73, a portion or all of the bottom panel 77 may be removed. When a portion or all of the bottom panel 77 is removed in this manner, the water w may drain immediately therefrom even when the defrosted water w penetrates into the fan assembly accommodation space 73. This may reduce a risk that water will penetrate into the motor 42 of the fan assembly 3, which will be described later, provided in the fan assembly accommodation space 73.

The fan assembly accommodation space 73 may have one short side that defines the opening 78. Thus, although the bottom panel 77 is not removed in that region, the water drain may be realized. Therefore, for drainage, the portion or all of the bottom panel 77 may not be removed intentionally.

However, when, in the region of the fan assembly accommodation space 73, the bottom panel 77 is not removed, an overall stiffness of the drip tray 7 may increase. On the other hand, when, in the region of the fan assembly accommodation space 73, the bottom panel 77 is removed, the fan assembly 3 as described later may be accommodated more deeply within the machine compartment, thereby reducing the entire height of the machine compartment.

The absence or presence of the bottom panel 77 on the fan assembly accommodation space 73 may be determined by a method of manufacturing the drip tray 7. For example, when the drip tray 7 is manufactured by bending a metal plate, the inner wall 76 may be formed by bending a bottom plate upwards in the region of the fan assembly accommodation space 73. In this case, the bottom panel 77 may be removed. The material and manufacturing method of the drip tray 7 may be variously selected so that defrosted water stored in the defrosted water storage space 71 may not leak.

In the fan assembly accommodation space 73, the fan assembly 3 may be fixedly received. To this end, the inner wall 76 may include a first retainer or hook 79 which may be fastened to the fan assembly 3 and fix the fan assembly 3. The first retainer 79 may include a cantilever extension that extends horizontally from the inner wall toward the fan assembly accommodation space, and a hook structure formed at distal end of the cantilever extension. The first retainer 79 may extend from the third inner wall surface, however, the disclosure is not limited thereto.

Hereinafter, the fan assembly 3 provided in the fan assembly accommodation space 73 of the drip tray 7 is described. The fan assembly 3 may include a fan 41, a motor 42 that generates power to rotate the fan, and a frame 30 that supports the motor and the fan.

The frame 30 may include a square outer frame 31 and a circular inner frame 32 provided inside the outer frame 31. Between the outer frame and the inner frame, a blocking plate 33 that closes a space between the outer frame and the inner frame may be provided.

The outer frame 31 may define an outer face of the fan assembly and may be a rigid structure that supports the fan assembly 3 as a whole. The outer frame 31 may have a width wide enough to secure the rigidity to support the fan assembly 3 as a whole and to stably support the fan assembly 3.

The inner circumferential face of the inner frame 32 may have a curved surface that guides air flow from the fan. The fan 41 may be provided within a fan air flow cross-section defined by the inner circumferential face of the inner frame 32. The fan 41 may be directly coupled to a rotation shaft of the motor 42 and may rotate together with the rotation shaft of the motor.

The motor 42 may be located at the center of the fan air flow cross-section. The frame 30 may include support arms 38 which may radially extend from the center of the fan air flow cross-section and which may be thinly formed so as not to interfere with fan air flow. The support arms 38 may support a motor fixing portion 39 that fixes the motor 42.

Figure 4:
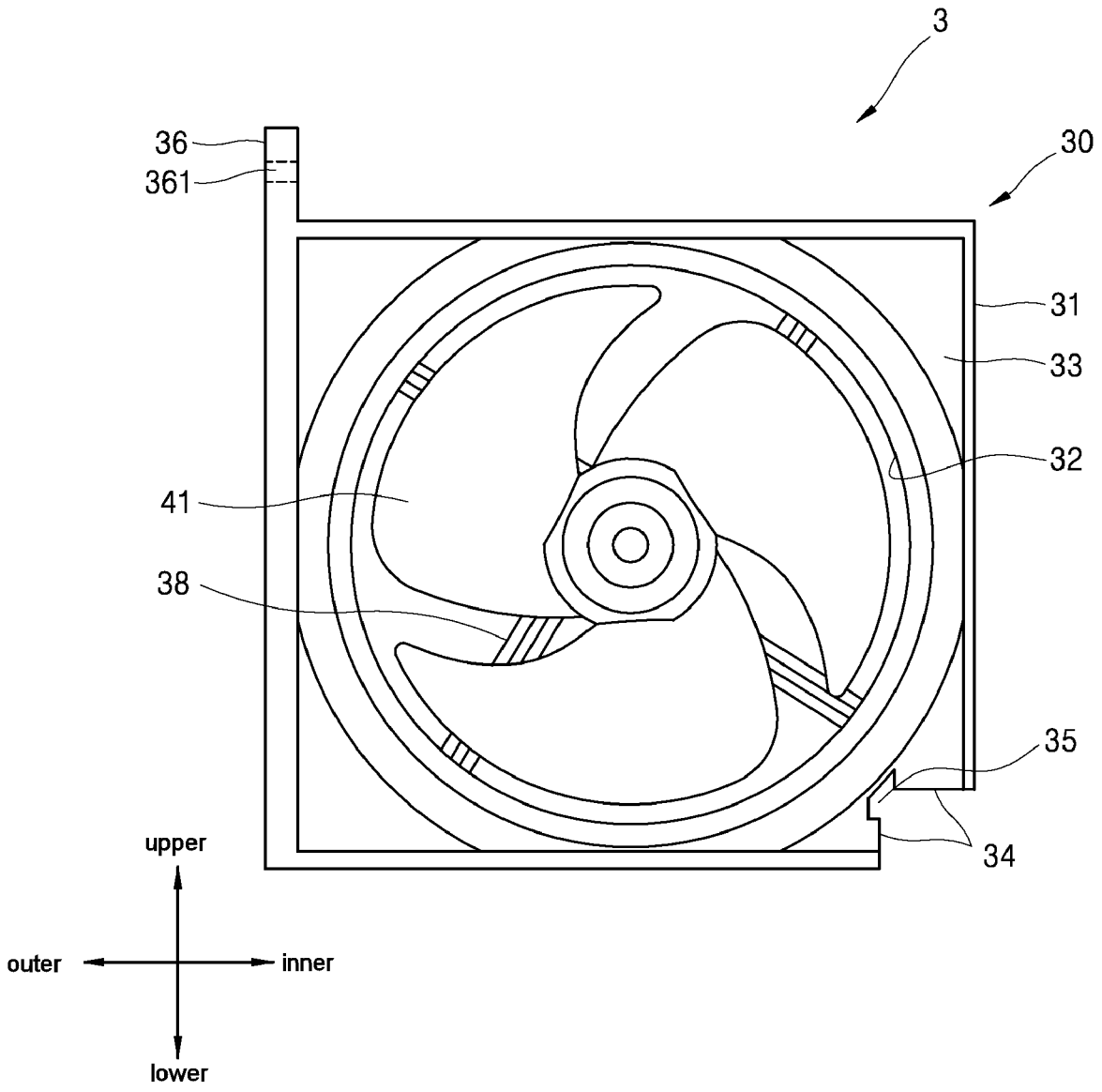
FIG. 4 is a side view of an embodiment of a fan assembly used in a refrigerator machine compartment.

Referring to FIG. 4, at the inner lower position of the fan assembly 3, a cutout 34 may be formed by partially cutting the frame 30. The cutout 34 may be formed by cutting a portion of the outer frame 31 and a portion of the blocking plate 33. The cut-out 34 may have a shape approximately corresponding to a cross-section shape of the communication space 713 of the drip tray.

Figure 5:
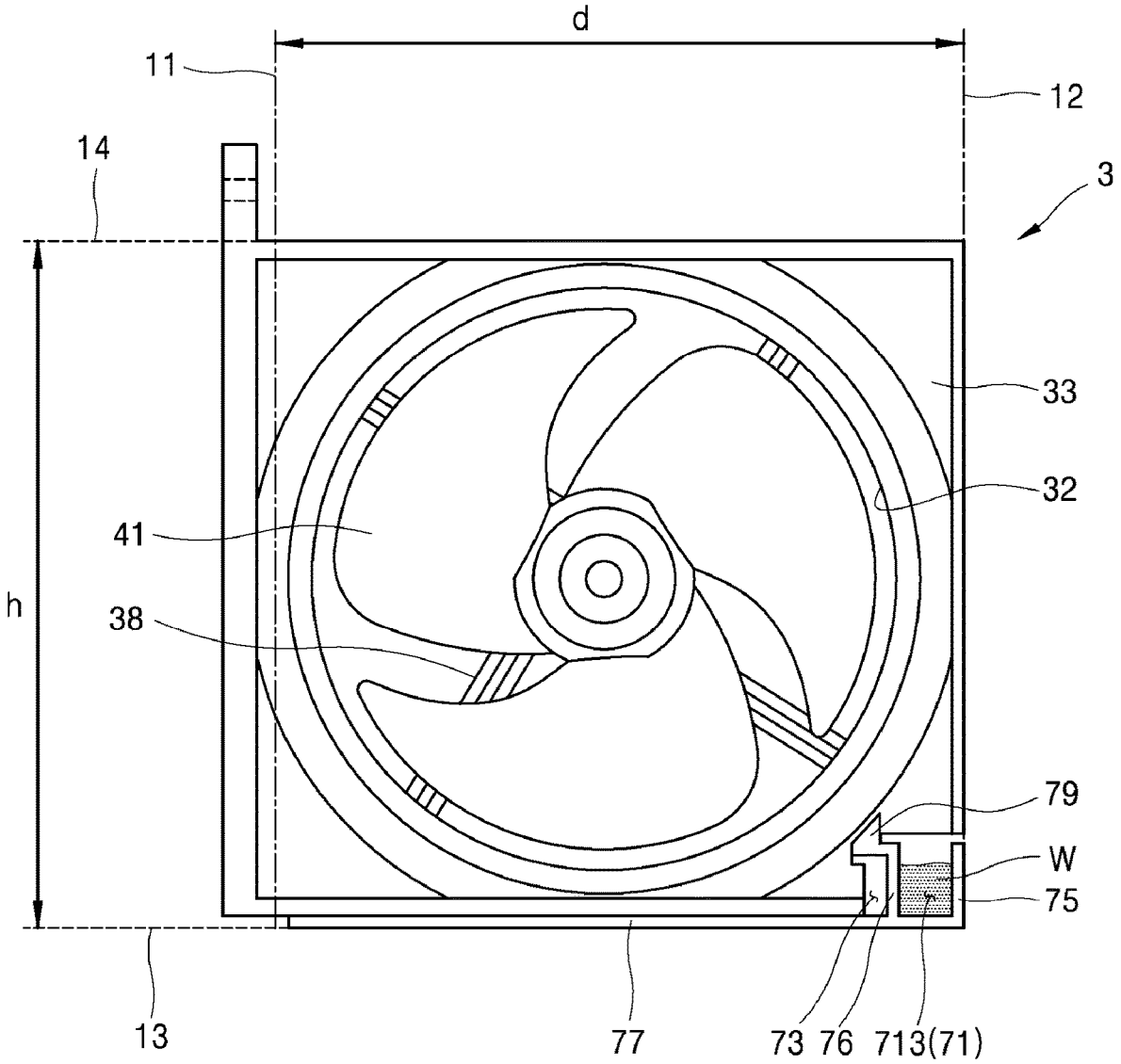
FIG. 5 is a side cross-sectional view of a coupled state between the drip tray of FIG. 3 and the fan assembly of FIG. 4.

Referring to FIGS. 3 and 5, the first retainer 79 may include an extension that extends laterally outward toward the fan assembly accommodation space 73 from the upper end of the inner wall 73 and a hook that protrudes upward from the distal end of the extension. Correspondingly, in an inner face portion of the cutout 34, a second retainer 35 may be defined. The second retainer 35 may be engaged with the first retainer 79 provided in the fan assembly accommodation space 73 of the drip tray 7 described above. Referring to FIG. 4, the second retainer or notch 35 may have a stopper onto which the hook may be hooked.

In one embodiment, a fixing support 36 may extend upward from the top portion of the frame 30. A through-hole 361 may be defined in the fixing support 36. The through-hole 361 may be a hole through which a screw or bolt passes. Thus, the fan assembly 3 may be fixed to the machine compartment.

Referring to FIGS. 3 to 8, a combined structure between the drip tray 7 and the fan assembly 3 according to the first embodiment will be described. Upper and lower ends and a front end of the machine compartment 10 may be closed, while a rear end of the machine compartment 10 may be opened. Thus, the machine compartment 10 may have a rectangular parallelepiped structure in which air channels are formed through which the air may circulate. That is, the machine compartment may have an elongate and flat rectangular parallelepiped shape.

The drip tray 7 may be provided on the bottom of the machine compartment 10. The long side of the drip tray 7 may be parallel to the longitudinal direction. Furthermore, the opening 78 of the drip tray 7 may face out of the machine compartment 10 in a rearward direction.

A compressor 20 may be provided on a first or left side of the drip tray 7. The compressor 20 may be provided on the bottom of the machine compartment 10 away from the drip tray 7. Furthermore, the first storage space 711 of the drip tray 7 may be arranged closer to the compressor 20. The compressor 20 may be provided above the first storage space 711 of the drip tray 7.

A heat-exchanger condenser 50 may be provided in the second storage space 712 of the drip tray 7. Within the machine compartment 10, the fan assembly accommodation space 73 may be arranged between the compressor 20 and the heat-exchanger 50. That is, the heat exchanger 50 may be arranged on the air discharge side of the fan assembly 3, while the compressor 20 may be provided on the air suction side of the fan assembly 3.

The fan assembly 3 may be inserted into the machine compartment 10 from a rear of the machine compartment 10, thereby placing the fan assembly 3 in the fan assembly accommodation space 73. The fan assembly 3 may be guided in the length direction along the first and second inner walls of the fan assembly accommodation space 73.

Figure 7:
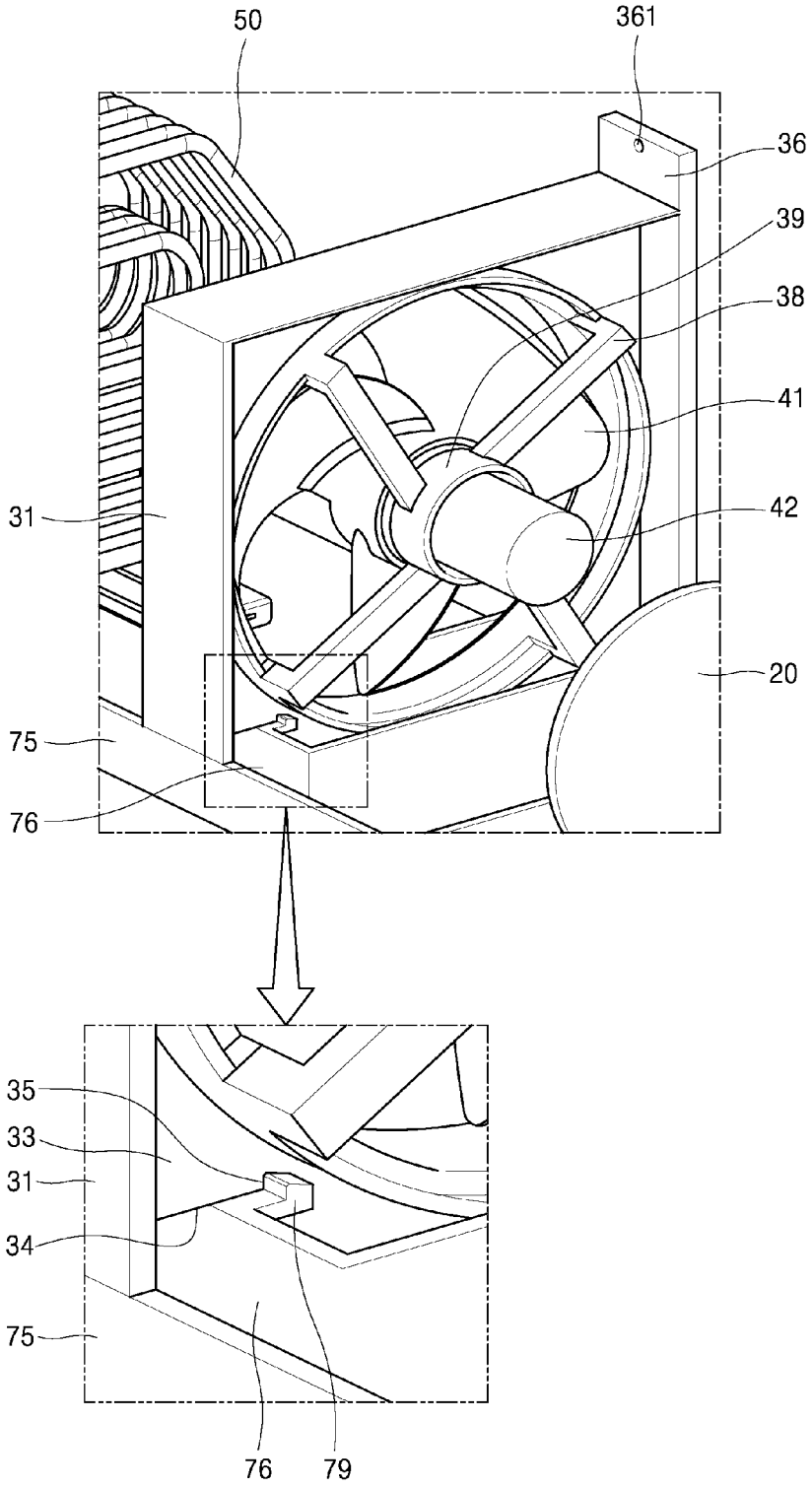
FIG. 7 shows internal perspective and enlarged views of a coupled state between the drip tray and the fan assembly.

When the fan assembly 3 is inserted up to an insertion depth, the hook, which may be the first retainer 79 of the drip tray 7 may be hooked onto the stopper which may be the second retainer 35 of the fan assembly 3. The hook may have an upper inclined surface facing out of the machine compartment 10. The inner face of the hook may be vertical. Therefore, during the insertion of the fan assembly 3, the first retainer may be elastically deformed. When the fan assembly 3 is completely inserted, the first retainer may be resiliently restored and may be engaged with the second retainer as shown in FIG. 7. Once the stopper and the hook are fastened to each other, the hook may not easily escape from the stopper.

A width of the first retainer 79 may be greater than a thickness of the blocking plate 33 of the fan assembly 3. Therefore, when the fan assembly 3 is to be separated and removed, a portion of the first retainer 79 exposed toward a side face of the blocking plate 33 of the fan assembly may be pushed downward as shown in FIG. 7 and the fan assembly 3 may be taken out of the machine compartment. After inserting the fan assembly 3 into the machine compartment, a fastener such as a screw may be inserted through the through-hole 361 of the fixing support 36 to further secure the fan assembly 3 to the machine compartment.

Referring to FIG. 5 and FIG. 7, when the drip tray 7 and fan assembly 3 are placed in machine compartment 10, an inner portion of the outer frame 31 of the fan assembly 3 which is disposed inside the machine compartment 10 may be aligned with an inner portion of the outer wall 75 of the drip tray 7 which may be provided inside the machine compartment 10. Thus, an inner boundary 12 of the machine compartment 10 may be aligned with the inner portion of the outer wall 75 of the drip tray 7 and the inner portion of the outer frame 31 of the fan assembly 3.

Figure 6:
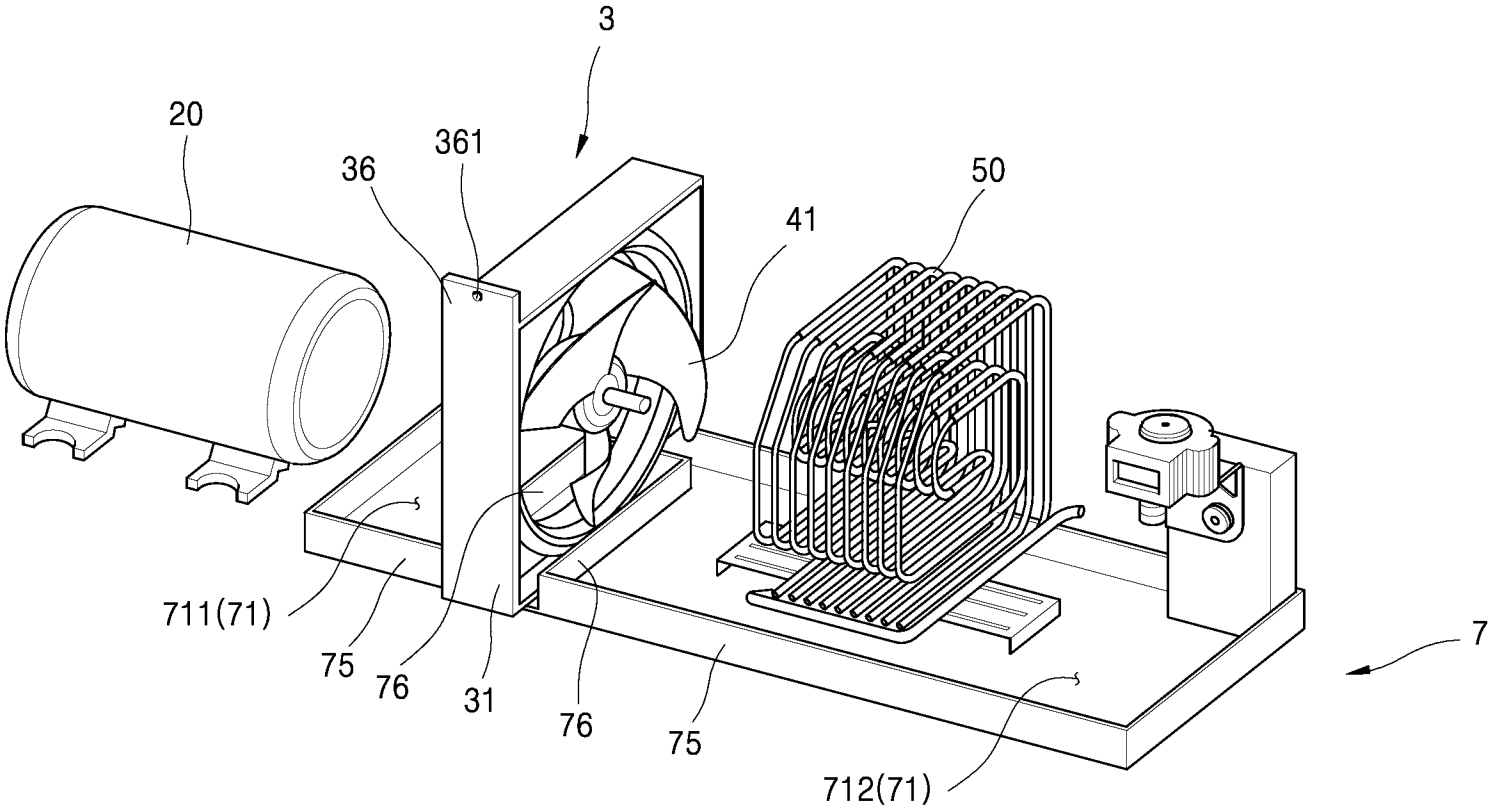
FIG. 6 is an external perspective view of an arrangement of a compressor, a drip tray, a fan assembly, and a heat-exchanger in a machine compartment.
Figure 8:
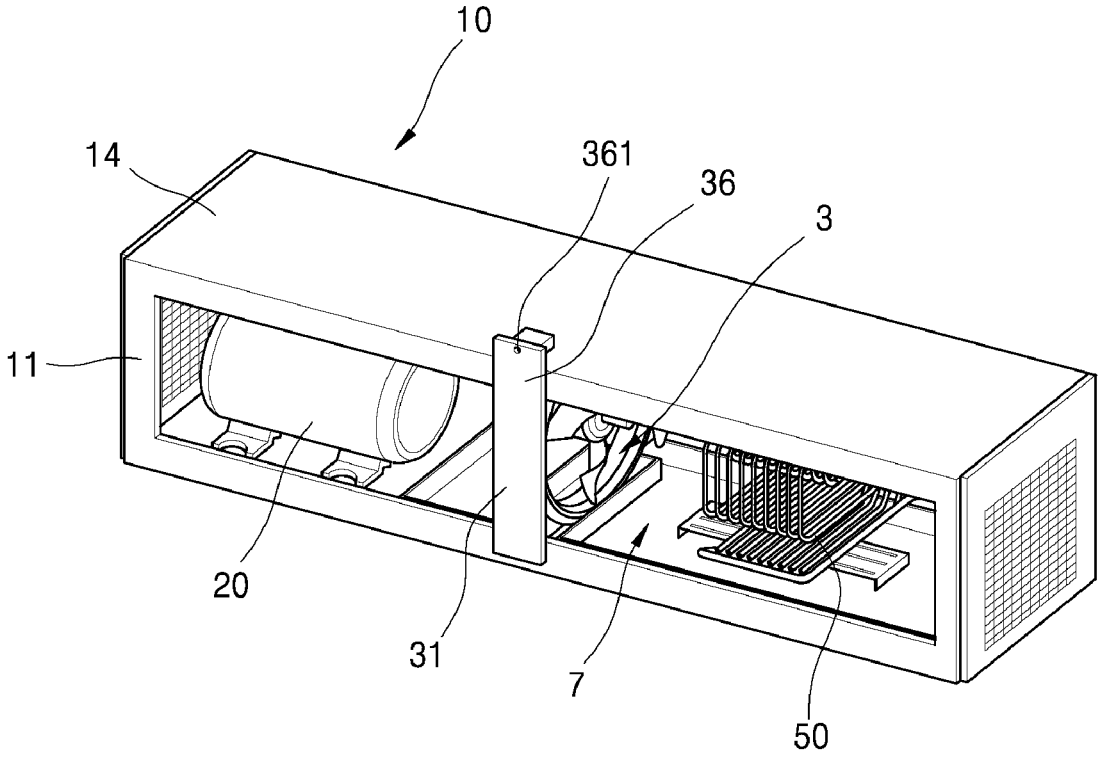
FIG. 8 is a perspective view of an arrangement of the compressor, drip tray, fan assembly, and heat-exchanger of FIG. 6 in the machine compartment.

Further Referring to FIG. 5, FIG. 6, and FIG. 8, when the drip tray 7 and fan assembly 3 are placed in machine compartment 10, an outer portion of the outer frame 31 of the fan assembly 3 may be provided further forward with an outer portion of the outer wall 75 of the drip tray 7. An outer boundary 11 of the machine compartment 10 may be arranged between the outer portion of the outer wall 75 of the drip tray 7 and the outer portion of the outer frame 31 of the fan assembly 3. That is, the outer boundary 11 of the machine compartment 10 may be provided outside of the outer portion of the outer wall 75 of the drip tray 7, while the outer boundary 11 may be arranged inside of the outer portion of the outer frame 31 of the fan assembly 3.

Thus, the depth d of the machine compartment may correspond to the length of the short side of the drip tray 7. The fan assembly 3 may be longer than the short side length of the drip tray 7.

In one embodiment, referring to FIGS. 5 and 8, a bottom boundary 13 of the machine compartment may be aligned with the lower face of the bottom panel 77 of the drip tray 7. Furthermore, a top boundary 14 of the machine compartment may be aligned with the upper end of the outer frame 31 of the fan assembly 3. Thus, the height h of the machine compartment may be determined as the distance between the bottom face of bottom panel 77 of drip tray 7 and the top face of outer frame 31 of fan assembly 3.

The fan assembly accommodation space 73 into which defrosted water does not leak may be defined within the region of the defrosted water storage space 71. Thus, unlike the related art, the lower end of the outer frame 31 of the fan assembly 3 may be in contact with the bottom panel 77 of the drip tray 7. Further, when, in the region of the fan assembly accommodation space, the bottom panel 77 is removed, the lower end of the outer frame 31 of the fan assembly 3 may be in contact with the bottom of the machine compartment 10. Thus, according to the present disclosure, the height h of the machine compartment may be determined solely by the height of the fan assembly 3.

Thus, the height h of the machine compartment 10 may correspond only to the height of the fan assembly 3, which may be smaller than a height of a fan assembly in the related art. Further, the depth d of the machine compartment 10 may be equal to or smaller than the depth of the fan assembly. That is, the area of the fan assembly 3 may be increased while reducing the volume of the machine compartment. Thus, heat exchange efficiency and defrosted water removal efficiency may be increased. Thus, the storage capacity of the refrigerator may be further increased.

In particular, while the machine compartment 10 maintains a contour frame thereof and the drip tray 7 is provided in the machine compartment 10, the fan assembly 3 may be inserted into the machine compartment 10 in a sliding manner. Thus, the assembly of the machine compartment 10 may be very simple while reducing the height h of the machine compartment 10 to substantially the same height as the height of the fan assembly 3.

Figure 9:
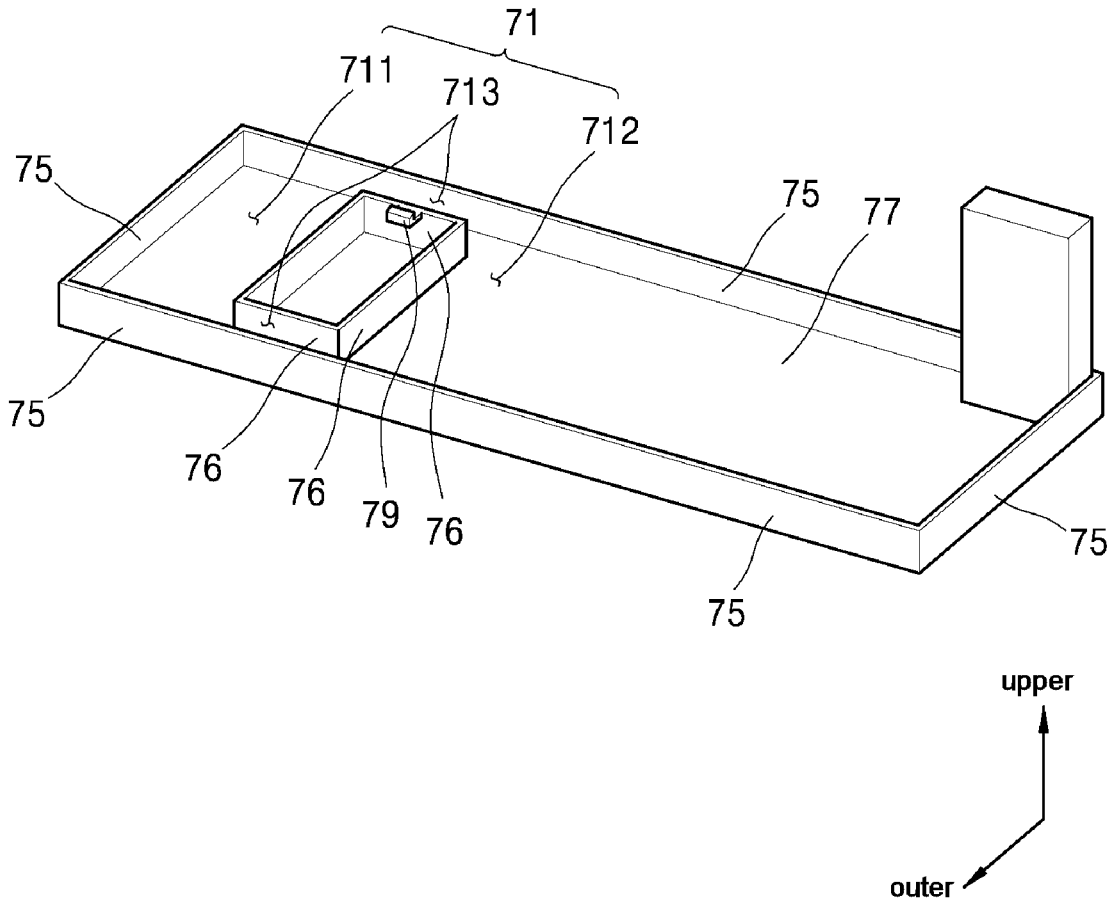
FIG. 9 is a perspective view of another embodiment of a drip tray used in a refrigerator machine compartment.

Hereinafter, a variant of a drip tray is illustrated. In a following example of a modified drip tray, the overlapping contents between the variant embodiment and the first embodiment will not be described in detail. The variant embodiment of the drip tray 7 provided within a machine compartment 10 may include a bottom member or panel 77 in the form of a substantially rectangular plate, and an outer wall 75 that extends upward from the edge of the bottom panel 77, as shown in FIG. 9.

The bottom panel 77 may have a rectangular shape including short sides and long sides. In the variant embodiment, the outer wall 75 may be formed in an outer closed loop shape defining the entire edge of the bottom panel 77. Further, in the drip tray 7 of the variant embodiment, the inner wall 76 may form an inner closed loop in the space defined by the outer wall 75 of the bottom panel 77, thereby defining a fan assembly accommodation space 73.

The fan assembly accommodation space 73 may have an elongated rectangular shape. The extending direction of the long side of the bottom panel 77 and the extending direction of the long side of the fan assembly accommodation space 73 may be perpendicular to each other. That is, the fan assembly accommodation space 73 may have a longitudinal direction perpendicular to the longitudinal direction of the drip tray 7.

The inner wall 76 may extend upward from the bottom panel 77. The inner closed loop may be formed by only the inner wall 76. The inner wall 76 may include first inner and second inner walls that extend in a direction parallel to the short side of the bottom panel 77, and third and fourth inner walls that connect distal and proximal ends of the first and second inner walls, respectively.

Each of the third and fourth inner walls may be parallel to the long side of the bottom panel 77. Each of the first and second inner walls may be longer than each of the third and fourth inner walls.

According to another embodiment, the drip tray 7 may have an outer wall 75 that defines both the two short sides and two long sides of the rectangular bottom panel 77. Furthermore, the inner wall 76 that defines the fan assembly accommodation space 73 in a rectangular shape may be formed in the space defined by the outer wall 75 of the bottom panel 77.

In the variant embodiment, the defrosted water storage space 71 may be provided inside the closed loop defined by the outer wall. The defrosted water storage space 71 may be defined out of the inner closed loop formed by the inner wall.

The defrosted water storage space 71 may be divided into two spaces by the fan assembly accommodation space 73. A first storage space 711 may be defined on a first side of the fan assembly accommodation space 73 along the longitudinal direction of the long side of the bottom panel 77, while a second storage space 712 may be defined on a second side of the fan assembly accommodation space 73 opposite the first side along the longitudinal direction of the long side of the bottom panel 77. The second storage space 712 may occupy a larger area than the first storage space 711.

The first storage space 711 and the second storage space 712 may communicate with each other through one or more communication spaces 713. Each communication space 713 may be defined between each of the third and fourth inner wall and the outer wall. Since the defrosted water may be a liquid, the defrost water contained in the first storage space 711 and the defrosted water contained in the second storage space 712 may communicate with each other through the communication space 713 and may have the same water level.

The communication space 713 may be defined between the long side of the outer wall 75 and the short side of the inner wall 76 of the fan assembly accommodation space 73. The communication space 713 may be provided at a first end in the longitudinal direction of the fan assembly accommodation space 73. The communication spaces 713 may also be provided respectively at both ends in the longitudinal direction of the fan assembly accommodation space 73.

The fan assembly accommodation space 73 may not accommodate defrosted water therein. Thus, in the location of the fan assembly accommodation space 73, a portion or all of the bottom panel 77 may be removed. When a portion or all of the bottom panel 77 is removed in this manner, the water w may drain immediately therefrom even when the defrosted water w penetrates into the fan assembly accommodation space 73. Thus, a risk that water will penetrate into the motor 42 of the fan assembly 3 as disposed in the fan assembly accommodation space 73 may be reduced.

Hereinafter, a fan assembly 3 provided within the fan assembly accommodation space 73 of the drip tray 7 according to a variant embodiment is illustrated. In the following modified fan assembly, the detailed descriptions of overlapping components between the variant embodiment and the first embodiment will be omitted.

Figure 10:
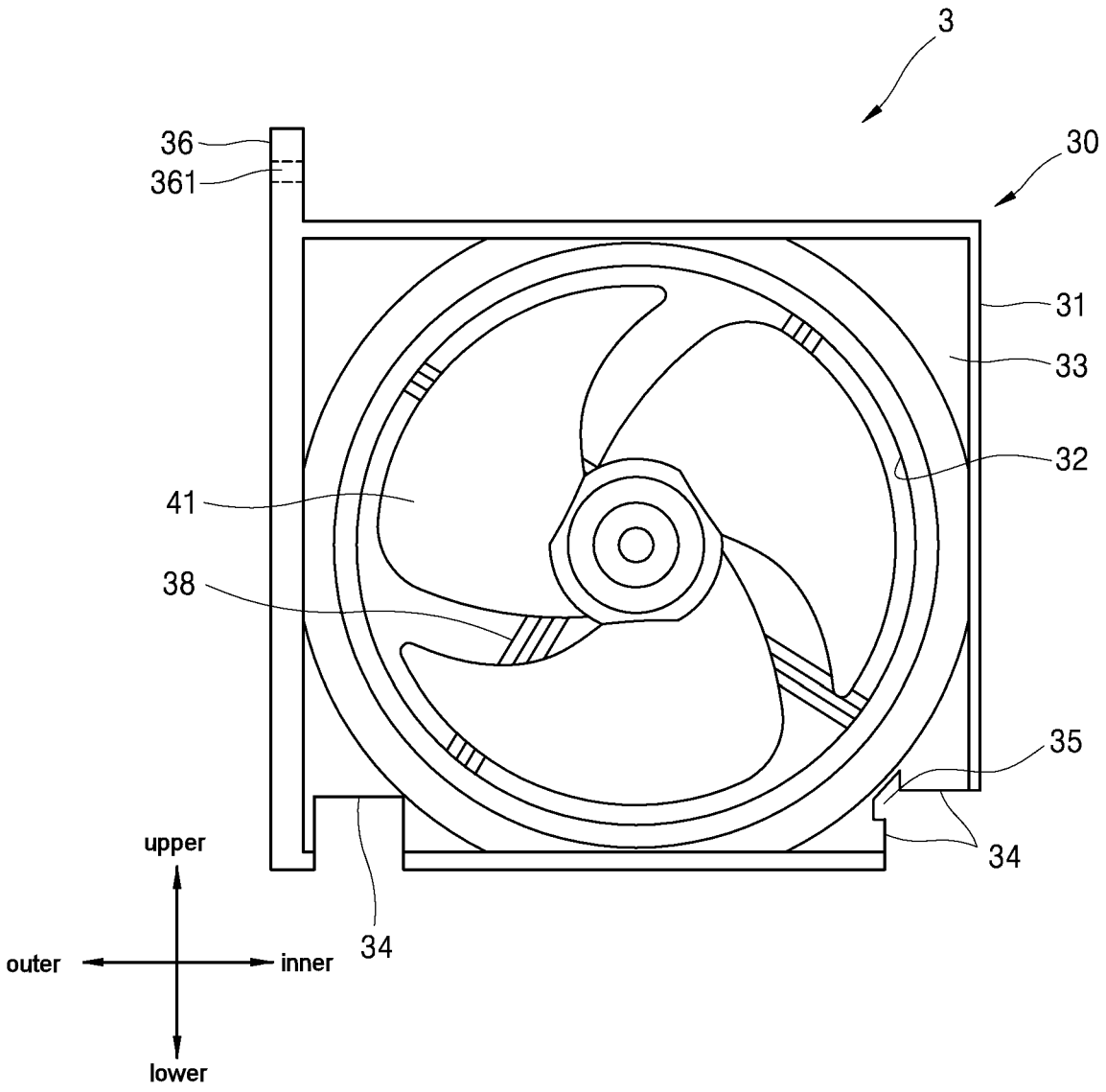
FIG. 10 is a side view of an embodiment of a fan assembly used in a refrigerator machine compartment.
Figure 11:
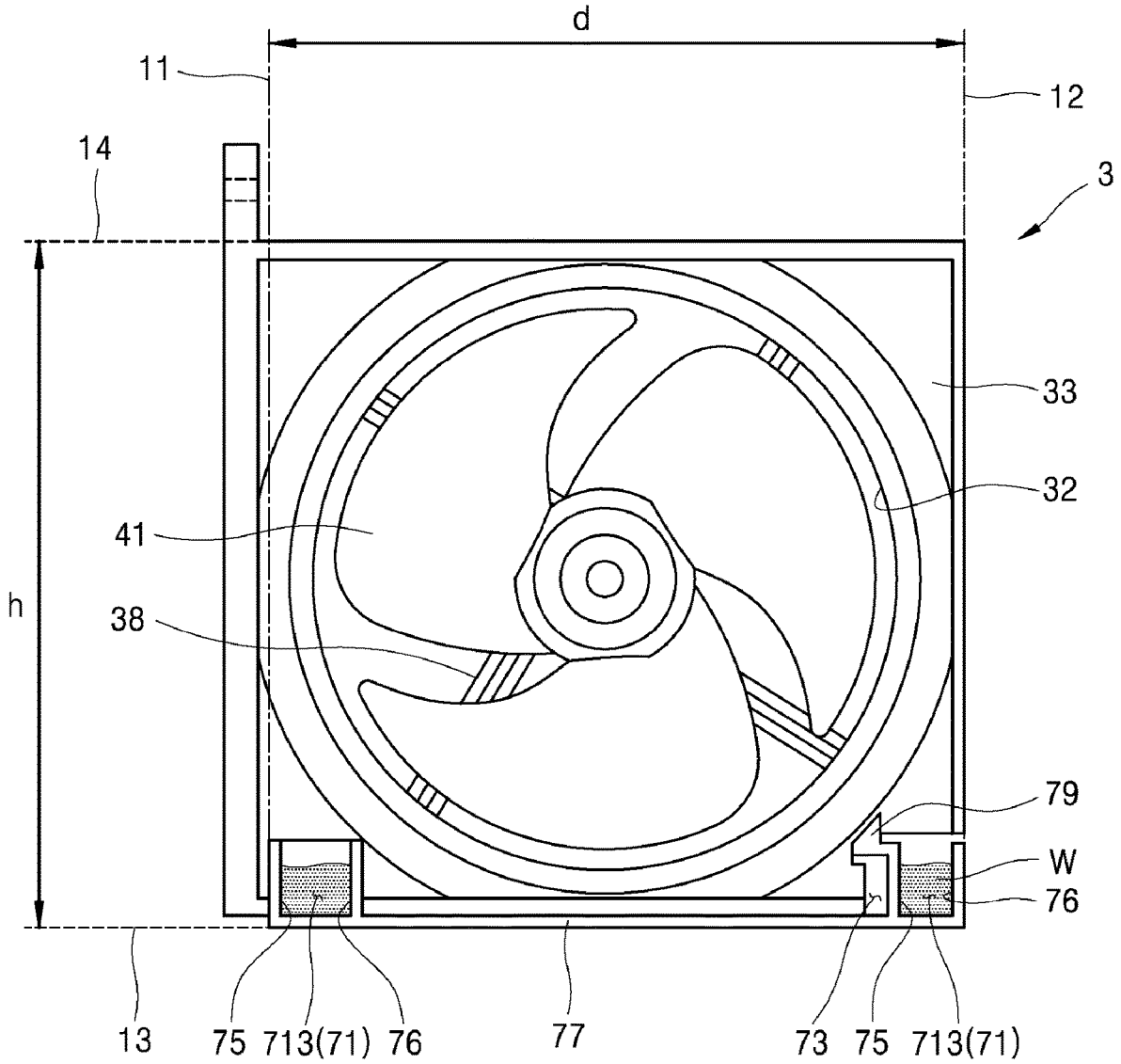
FIG. 11 is a cross-sectional side view of a coupled state between the fan assembly of FIG. 10 and the drip tray of FIG. 9.

Referring to FIG. 10, at both opposite or inner and outer lower positions of the fan assembly 3, inner and outer cutouts 34 defined by partially cutting the frame 30 may be formed respectively. The inner and outer cutouts 34 may be formed by cutting portions of the outer frame 31 and portions of the blocking plate 33. Each of the inner and outer cut-outs 34 may have a shape approximately corresponding to a cross-section shape of the communication space 713 of the drip tray 7. It may be possible to realize a compact machine compartment by reducing both the height h and the depth d of the machine compartment.

The embodiments are designed to solve the above problem. A purpose of the embodiments is to provide a drip tray and fan assembly having a structure capable of reducing a volume of a machine compartment of a refrigerator without reducing the size of the fan assembly, and to provide a refrigerator including a machine compartment containing a drip tray and fan assembly. Another purpose of the embodiments is to provide a drip tray and fan assembly which may be easily placed inside a compact machine compartment, and to provide a refrigerator including the machine compartment containing a drip tray and fan assembly.

A drip tray may include a defrosted water storage space defined by a bottom member and an outer wall extending upwardly from the bottom member. The drip tray may have a fan assembly accommodation space defined therein in which a fan assembly is disposed. At least a portion of the fan assembly accommodation space may be defined by an inner wall extending upwardly from the bottom panel. The fan assembly accommodation space may be blocked via the inner wall from the defrosted water storage space such that defrosted water is absent in the fan assembly accommodation space.

The fan assembly accommodation space may extend in an elongate manner to be perpendicular to a longitudinal direction of an elongate drip tray. The fan assembly accommodation space may divide the defrosted water storage space into a first storage space and a second storage space. A communication space for communicating the first storage space and the second storage space with each other may be defined between the fan assembly accommodation space and the outer wall.

The communication space may be disposed adjacent to at least one of both opposite longitudinal ends of the fan assembly accommodation space. The fan assembly accommodation space may communicate with an opening defined in a portion of the outer wall. The outer wall and the inner wall may be connected to each other to define a first closed loop, wherein the defrosted water storage space may be defined in the first closed loop.

The outer wall may define a second closed loop. The inner wall may define a third closed loop disposed within the second closed loop. The defrosted water storage space may be defined between the second closed loop and the third closed loop. The inner wall may include a first retainer. The first retainer may be fastened to the fan assembly to retain the fan assembly in the fan assembly accommodation space. The bottom member may be at least partially or entirely removed in the fan assembly accommodation space.

A machine compartment for a refrigerator may include a drip tray, a fan assembly received in a fan assembly accommodation space, and a machine compartment for receiving therein the fan assembly and drip tray.

The frame may include: an outer frame defining an outer face of the fan assembly; an inner frame provided inside the outer frame and defining an inner face of the fan assembly; a blocking plate for blocking a space interposed between the outer frame and the inner frame and for connecting the outer frame and the inner frame; and a fan rotatably received inside the inner frame. The frame may have a cutout, wherein the cut-out may be a portion of the frame which is overlapped with the defrosted water storage space beyond the inner wall when the fan assembly is disposed in the fan assembly accommodation space.

The cut-out may include a cut-out of a part of the outer frame and a cut-out of a part of the blocking plate. The outer frame may have a substantially square shape, and the inner frame may have a substantially circular shape. The cut-out may include at least a cut-out in a bottom corner of the outer frame. The cut-out may have a second retainer engaged with a first retainer provided on the inner wall.

The first retainer may include a cantilevered extension extending in a horizontal direction and a hook provided at a distal end of the extension. The second retainer may include a stopper hooked onto the hook. An inner end of the outer frame of the fan assembly may be disposed on the outer wall of the drip tray located inside the machine compartment.

An outer end of the outer frame of the fan assembly may be positioned more outwardly than an outer boundary of the machine compartment. A bottom of the outer frame of the fan assembly may contact the bottom member in the fan assembly accommodation space.

The machine compartment may further comprise a heat-exchanger provided on an air discharge side from the fan assembly. The heat exchanger may be disposed above the defrosted water storage space. The machine compartment may further comprise a compressor provided on an air suction side from the fan assembly. The compressor may be received in the machine compartment from outside of the defrosted water storage space.

An assembly set may include a drip tray and a fan assembly, wherein the assembly set is disposed in a machine compartment for a refrigerator. The fan assembly may include: a fan for generating fan air flow by rotation thereof; and a frame for supporting the fan. The drip tray may include a fan assembly accommodation space for receiving the fan assembly therein; and an opening laterally and outwardly open to communicate with the fan assembly accommodation space. The fan assembly may be inserted into or withdrawn out of the fan assembly accommodation space through the opening.

The fan assembly may include a second retainer engaged with the drip tray. The drip tray may include a first retainer engaged with the second retainer. One of the first retainer and the second retainer may include a cantilevered extension extending in a horizontal direction and a hook provided at a distal end of the extension. The other of the first retainer and the second retainer may include a stopper hooked onto the hook.

The drip tray may include an inner wall surrounding the fan assembly accommodation space. The inner wall may guide insertion of the frame of the fan assembly laterally into the fan assembly accommodation space. The inner wall may support the fan assembly when the fan assembly is received in the space.

A width of the extension may be greater than a width of the stopper, such that the hook may be separated from the stopper as the extension is deformed by pressing a portion of the extension exposed through an open face of the stopper. The drip tray may include a bottom member, and an outer wall extending upwardly from the bottom member. The opening may be at the outer wall.

The drip tray may include an inner wall connected to the outer wall at the opening and extending upwardly from the bottom member. The inner wall may be formed substantially in a "⊃" shape, wherein a portion of the shape opposite to the opening is closed. The connection of the outer wall and the inner wall may define a closed loop. The bottom member, the outer wall and the inner wall may define the defrosted water storage space.

A space surrounded by the inner wall and the opening may define the fan assembly accommodation space. The bottom member may be at least partially or entirely removed in the fan assembly accommodation space.

The fan assembly accommodation space may divide the defrosted water storage space into a first storage space and a second storage space. A communication space for communicating the first storage space and the second storage space with each other may be defined between the fan assembly accommodation space and the outer wall, wherein the communication space is disposed opposite to the opening.

The second storage space may occupy a wider area than the first storage space. A heat-exchanger may be disposed above the second storage space. The frame may include: an outer frame defining an outer face of the fan assembly; an inner frame provided inside the outer frame and defining an inner face of the fan assembly; and a blocking plate for blocking a space interposed between the outer frame and the inner frame and for connecting the outer frame and the inner frame.

The frame may have a cut-out, wherein the cut-out is defined beyond the fan assembly accommodation space when the fan assembly is disposed in the fan assembly accommodation space. The cut-out may be a cut out portion of the frame overlapped with the communication space of the defrosted water storage space. The frame may have a substantially square shape, while the cut-out may include a cut-out defined in a lower corner of the frame.

A machine compartment for a refrigerator may include: an assembly set including a drip tray and a fan assembly, and a machine compartment for receiving therein the assembly set. A fixing support may extend upwardly from a top of the frame. The fixing support may be fixed to the machine compartment while being disposed outside the machine compartment. A refrigerator may have the machine compartment for the refrigerator as defined above.

A volume of the machine compartment may be reduced without reducing the size of the fan assembly. As a result, cooling of the compressor and heat exchange efficiency of the heat exchanger (condenser) may be enhanced, and, further, a storage space for the refrigerator may be further secured.

Further, although the machine compartment is compact and thus a space for assembly of components is reduced, the drip tray and fan assembly may be conveniently assembled in the machine compartment. The specific effects of the embodiments as well as effects as described above will be described with reference to specific examples for carrying out the embodiments.

The detailed advantageous effects according to the present disclosure as well as the aforementioned effect have described above with regard to the embodiments of the present disclosure. The present disclosure described above may be variously substituted, altered, and modified by those skilled in the art to which the present disclosure pertains without departing from the scope and sprit of the present disclosure. Therefore, the present disclosure is not limited to the above-mentioned exemplary embodiments and the accompanying drawings.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An assembly set including a drip tray and a fan assembly configured to be placed in a machine compartment of a refrigerator, the drip tray comprising:

a bottom panel; and a plurality of first and second walls that extend upward from the bottom panel, wherein each of the plurality of first and second walls has an inner surface and an outer surface, wherein the bottom panel, the inner surfaces of the plurality of first walls, and the outer surfaces of the plurality of second walls define a water storage space to receive water which has defrosted in the refrigerator, wherein the inner surfaces of the plurality of second walls define a fan assembly mounting space in which at least a portion of the fan assembly is mounted and water is not received, and the fan assembly mounting space is blocked from the water storage space via the plurality of second walls such that water does not flow into the fan assembly mounting space, and wherein the drip tray is configured to be placed in the machine compartment of the refrigerator, and wherein the fan assembly mounting space divides the water storage space into a first storage space and a second storage space, and the first storage space is provided on an air suction side of the fan assembly while the second storage space is arranged on an air discharge side of the fan assembly.

2. The assembly set of claim 1, wherein the fan assembly mounting space includes a laterally opened opening defined by at least one of the plurality of first walls.

3. The assembly set of claim 1, wherein the plurality of first and second walls are connected to each other to define a closed loop, and wherein the water storage space is defined within the closed loop.

4. The assembly set of claim 1, wherein the plurality of first walls defines a first closed loop, wherein the plurality of second walls defines a second closed loop located within the first closed loop, and wherein the water storage space is defined between the first closed loop and the second closed loop.

5. The assembly set of claim 1, wherein a first hook protrudes from one of the plurality of second walls, the first hook being configured to be fastened to the fan assembly to hold the fan assembly in the fan assembly mounting space.

6. The assembly set of claim 1, wherein a thickness of the bottom panel for the water storage space is greater than a thickness of the bottom panel for the fan assembly mounting space.

7. The assembly set of claim 1, wherein the bottom panel is provided only at the water storage space.

8. The assembly set of claim 1, wherein a length of the drip tray in a first direction is longer than a width of the drip tray in a second direction perpendicular to the first direction, wherein a length of the fan assembly mounting space in the second direction is longer than a width of the fan assembly mounting space in the first direction, wherein the fan assembly mounting space divides, in the second direction, the water storage space into the first storage space and the second storage space, and wherein a communication space that allows the first storage space and the second storage space to communicate with each other is defined between the fan assembly mounting space and one of the plurality of first walls in the second direction.

9. The assembly set of claim 8, wherein the communication space is adjacent to at least one end of the fan assembly mounting space in the second direction.

10. An assembly set including a drip tray and a fan assembly, wherein the assembly set is provided in a machine compartment of a refrigerator, and wherein the fan assembly includes:

a fan configured to generate air flow by rotation thereof; and a frame configured to support the fan, wherein the drip tray includes:

a bottom panel;

a plurality of first and second walls that extends upward from the bottom panel, each of the plurality of first and second walls having an inner surface and an outer surface;

a water storage space defined by the bottom panel, the inner surfaces of the plurality of first walls, and the outer surfaces of the plurality of second walls; and a fan assembly mounting space defined by the inner surfaces of the plurality of second walls, configured to at least partially receive the fan assembly therein and configured not to receive water therein, wherein the fan assembly mounting space is blocked from the water storage space via the plurality of second walls such that water does not flow into the fan assembly mounting space, wherein the fan assembly mounting space divides the water storage space into a first storage space and a second storage space, and the first storage space is provided on an air suction side of the fan assembly while the second storage space is arranged on an air discharge side of the fan assembly.

11. The assembly set of claim 10, wherein the fan assembly mounting space includes a laterally opened opening defined by at least one of the plurality of first walls, and wherein the fan assembly is configured to be at least partially inserted into or withdrawn out of the fan assembly mounting space through the opening.

12. The assembly set of claim 11, wherein the drip tray includes a first retainer, wherein the fan assembly includes a second retainer configured to engage with the first retainer, wherein one of the first retainer and the second retainer includes a cantilevered extension tab that extends in a horizontal direction and a hook provided at a distal end of the extension tab, and wherein the other of the first retainer and the second retainer includes a notch configured to be hooked onto the hook.

13. The assembly set of claim 12, wherein a width of the extension tab is greater than a width of the notch, such that a portion of the extension tab is exposed adjacent to the notch and is configured to be pressed in order to be separated from the notch.

14. The assembly set of claim 11, wherein the plurality of second walls is configured to guide insertion of the frame of the fan assembly into the fan assembly mounting space, and wherein the plurality of second walls supports the fan assembly when the fan assembly is received in the fan assembly mounting space.

15. A machine compartment of a refrigerator, wherein a drip tray and a fan assembly are assembled with each other in the machine compartment, wherein the fan assembly includes:

a fan configured to generate air flow by rotation thereof; and a frame that supports the fan, wherein the drip tray includes:

a bottom panel;

a plurality of first and second walls that extends upward from the bottom panel, each of the plurality of first and second walls having inner and outer surfaces;

a water storage space defined by the bottom panel, the inner surfaces of the plurality of first walls, and the outer surfaces of the plurality of second walls; and a fan assembly mounting space defined by the inner surfaces of the plurality of second walls, configured to receive the fan assembly therein and configured not to receive water therein, wherein the fan assembly mounting space is blocked from the water storage space via the plurality of second walls such that water does not flow into the fan assembly mounting space, wherein the fan assembly mounting space divides the water storage space into a first storage space and a second storage space, and the first storage space is provided on an air suction side of the fan assembly while the second storage space is arranged on an air discharge side of the fan assembly.

16. The machine compartment of claim 15, wherein the frame includes:

an outer frame that defines an outer face of the fan assembly;

an inner frame provided inside the outer frame that defines an inner face of the fan assembly; and a blocking plate that connects the outer frame and the inner frame, wherein the fan is rotatably received inside the inner frame, wherein the frame includes a cut-out, and wherein the cut-out overlaps a portion of the water storage space and the plurality of second walls when the fan assembly is arranged in the fan assembly mounting space.

17. The machine compartment of claim 16, wherein the cut-out includes a cut-out of the outer frame and a cut-out of the blocking plate.

18. The machine compartment of claim 16, wherein the outer frame has a substantially square shape, the inner frame has a substantially circular shape, and the cut-out includes at least a cut-out in a bottom corner of the outer frame.

19. The machine compartment of claim 16, wherein a bottom of the outer frame of the fan assembly contacts the bottom panel in the fan assembly mounting space.

* * * * *